US007201682B2

(12) United States Patent
Tucker, Sr. et al.

(10) Patent No.: US 7,201,682 B2
(45) Date of Patent: Apr. 10, 2007

(54) FIELD HOCKEY STICK HAVING A TOP WEIGHTED HEAD

(75) Inventors: Richard B. C. Tucker, Sr., Ruxton, MD (US); Kenneth E. Sherman, Hampstead, MD (US)

(73) Assignee: STX, LLC, Baltimore, MD (US)

( * ) Notice: Subject to any disclaimer, the term of this patent is extended or adjusted under 35 U.S.C. 154(b) by 0 days.

(21) Appl. No.: 11/030,953

(22) Filed: Jan. 10, 2005

(65) Prior Publication Data

US 2005/0164814 A1 Jul. 28, 2005

Related U.S. Application Data

(60) Provisional application No. 60/534,968, filed on Jan. 9, 2004.

(51) Int. Cl.
*A63B 59/12* (2006.01)

(52) U.S. Cl. ..... 473/563

(58) Field of Classification Search ..... 473/560–563
See application file for complete search history.

(56) References Cited

U.S. PATENT DOCUMENTS

D244,790 S 6/1977 Carlson et al.
4,512,573 A * 4/1985 Coolen ..... 473/559
5,603,498 A * 2/1997 Crawford et al. ..... 473/563
5,935,029 A * 8/1999 Cyr et al. ..... 473/563
2002/0065154 A1* 5/2002 Goldsmith et al. ..... 473/560

FOREIGN PATENT DOCUMENTS

GB 2 033 238 A 5/1980
GB 2298799 A * 9/1996
JP 08173581 A * 7/1996
WO WO 98/28052 * 7/1998
WO WO 01/23047 A1 * 4/2001

OTHER PUBLICATIONS

PCT Search Report dated Aug. 23, 2005.

* cited by examiner

*Primary Examiner*—Mark S. Graham
(74) *Attorney, Agent, or Firm*—Paul, Hastings, Janofsky & Walker LLP

(57) ABSTRACT

A field hockey stick including a throat and a head adjoining the throat, the head having an upper portion adjacent to the throat and a lower portion, and at least the lower portion of the head defining at least one depression. The throat can also define a throat depression.

23 Claims, 8 Drawing Sheets

PRIOR ART

FIELD HOCKEY STICK HAVING A TOP WEIGHTED HEAD

This application claims the benefit of U.S. Provisional Application No. 60/534,968, filed Jan. 9, 2004, which is herein incorporated by reference in its entirety.

BACKGROUND

1. Field of the Invention

The present invention relates generally to field hockey sticks, and more particularly, to a field hockey stick having a top weighted head.

2. Background of the Invention

As shown in FIG. 1, a field hockey stick 100 typically has a handle 102, a throat 104, and a head 106. The handle 102 starts at a first distal end of stick 100 and extends to throat 104. The stick 100 then curves at the base of the throat 104 to form the head 106 at the second distal end of stick 100. A horizontal line (such as line 115) drawn through the point at which stick 100 begins to curve marks the end of throat 104 and the beginning of head 106. The head 106 is also considered the base of the stick 100. The head 106 includes a toe 108 and curves horizontally and upwardly to form toe 108. The front (or left hand side, as shown in FIG. 1) of the stick 100 has a flat playing surface and the back is no-flat (e.g., rounded or curved) and not playable in a game. Generally, the flat playing surface includes all of head 106 and at least a portion of throat 104. All sticks are suitable for "right handed" play.

Traditionally, field hockey sticks have been constructed of relatively standard dimensions, due primarily to widely accepted rules of the game. These rules dictate aspects of the stick such as weight, length, shape, and cross section. As one example, the rules require that the playing portion of the stick have a flat face and that every cross section of the stick be able to pass through a two-inch ring. In meeting these rules, the traditional field hockey stick has typically featured a flat front face and a curved back and back head of a relatively uniform shape.

The total weight of a field hockey stick as defined by widely accepted rules must not exceed 737 grams. Within these parameters, field hockey sticks, including field hockey stick heads that are curved and have rounded backs, have a traditional shape and weight disbursement.

In the game of field hockey, players typically favor passes and shots that are hard and low. Indeed, the more powerful the drive, the better chance the pass or shot has of eluding defenders. This increase in power, however, also increases the chance of losing control of the ball, especially in terms of lofting the ball illegally. These passes and shots are hit from an upright standing position and the ball must travel on or near the ground in a relatively straight line. A miss-hit ball often rises up in the air above knee level, which can result in the loss of possession and can be harmful to other players. Thus, a principal object of powerful drives is to keep the ball close to the ground. The object is to hit the ball hard but minimize its loft. Shooting low and hard on goal can significantly increase the chances of scoring, either through deflected shots or from rebounds off of the goalie. Keeping the ball low helps control passes and shots, while not violating game rules against lofted balls, which result in the opposing team gaining possession of the ball. Players therefore prefer field hockey sticks that meet this need.

Field hockey sticks are typically made of wood or composites. As used herein, composites refer to field hockey sticks made by bladder molding or by wrapping sheets of uncured fiber-reinforced thermosetting resin around a mandrel, which is then withdrawn to form a hollow tubular lay-up. Examples of the materials used in the resin include fiberglass, carbon, and aramid. Composite sticks have been available on the market for several years and have been approved for use in international play for over a year.

It is widely believed that composite sticks generate more powerful drives than wooden sticks. With this additional power, however, comes a potential for loss of control, especially if a ball is unintentionally lofted during the drive. Minimizing this loft would therefore result in players delivering a more powerful drive without sacrificing ball control.

Therefore, field hockey sticks, especially composite field hockey sticks, would benefit greatly from a feature that minimizes the loft that can occur upon contact with a ball, and the resulting loss of ball control.

SUMMARY OF THE INVENTION

The present invention provides a field hockey stick having a head with a raised center of gravity that minimizes loft and imparts an improved feel when striking a ball with the stick.

One embodiment of the present invention provides a field hockey stick comprising a throat and a head adjoining the throat. The head has an upper portion adjacent to the throat and a lower portion. At least the lower portion of the head defines at least one depression.

Another embodiment of the present invention provides a field hockey stick comprising a handle, a throat adjacent to the handle, and a head adjacent to the throat on a side of the throat opposite to the handle, in which the throat defines at least one depression. The head, which has a first end attached to the throat and a second end opposite to the first end, has a center of gravity disposed greater than about 1.5 inches from the second end of the head.

Another embodiment of the present invention provides a field hockey stick comprising a handle, a throat adjacent to the handle, and a head adjacent to the throat on a side of the throat opposite to the handle. The throat has a flat playing side and a non-flat (e.g., round or curved) non-playing side. The non-playing side of the throat defines at least one throat depression. The head has a flat playing side and a non-flat (e.g., round or curved) non-playing side. The non-playing side of the head defines at least one head depression. The at least one head depression can be disposed closer to an end of the head opposite to the throat than to the throat.

DETAILED DESCRIPTION OF THE INVENTION

Traditionally the center of gravity in the head of a field hockey stick has been designed so that it is in line with or below the center of gravity of a field hockey ball, when both the head and the ball are resting on the same plane. The circumference of a field hockey ball is typically about 8.8125 to 9.25 inches, with a radius to its center of about 1.40 to 1.47 inches. Therefore, the head of a traditional field hockey stick typically has a center of gravity within about 1.47 inches from the bottom of the head. As used herein, center of gravity refers to the point at which the entire weight of a body may be considered as concentrated so that, if supported at this point, the body would remain in equilibrium in any position. By raising the center of gravity of the head, the present invention changes the moment of impact on a ball and its resultant launch angle. The higher that the center of gravity of the head is above the center of gravity of the ball, the lower the launch angle on the ball will be.

Embodiments of the present invention raise the center of gravity in a field hockey stick head by one or more of the following methods: 1) removing material from a part of the head; 2) adding material to a part of the head; 3) repositioning or redistributing material in the stick, such as in the areas of the head and the throat; 4) using two or more materials with different mass or density properties in the head; and 5) combinations thereof.

Composite field hockey sticks are traditionally manufactured by a process referred to as bladder molding, which uses an air bladder, a two-part female mold, composite material, and resin. The bladder is inflated, thus creating pressure to force the composite and resin against the mold until it cures. This process results in a hollow hockey stick.

Figure 1:
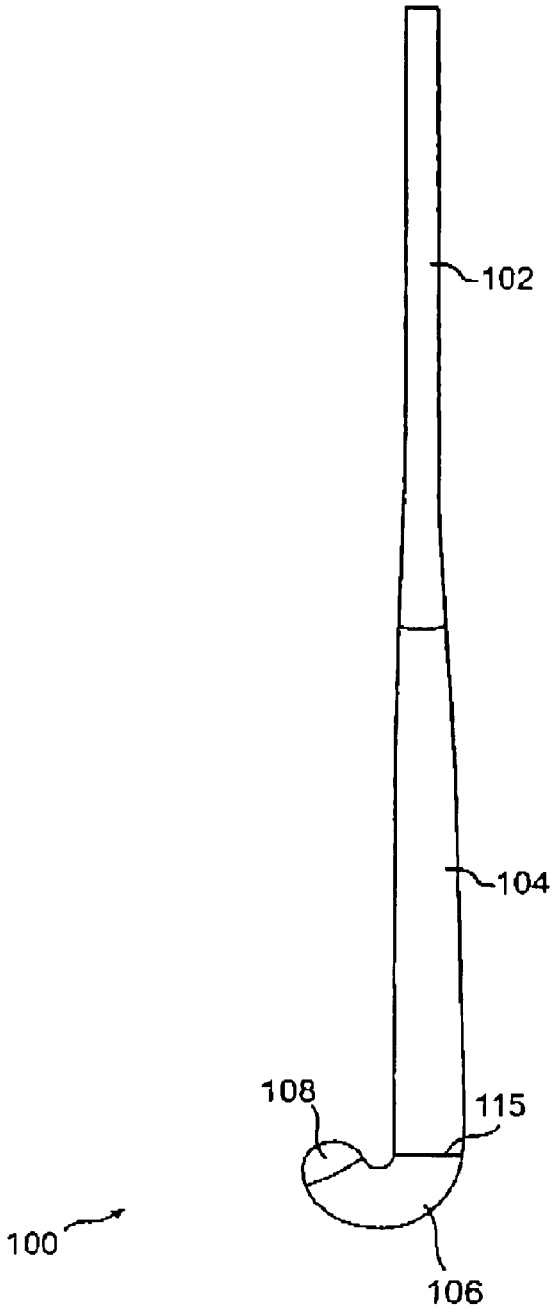
FIG. 1 is a schematic diagram of a conventional field hockey stick.
Figure 2:
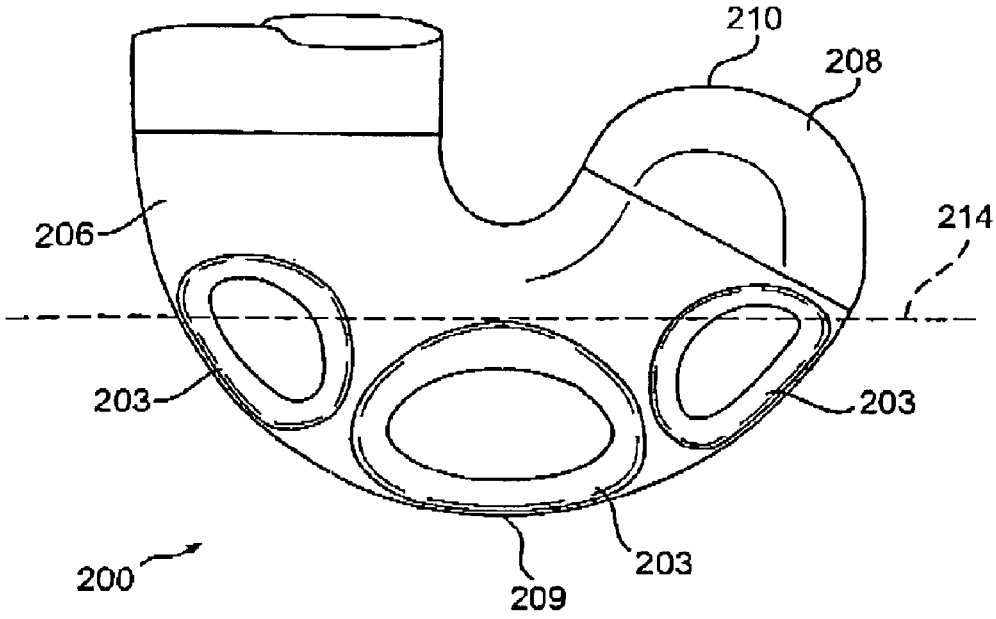
FIG. 2 is a schematic diagram of an exemplary field hockey stick having depressions in its head, according to an embodiment of the present invention.

According to an embodiment of the present invention, FIG. 2 illustrates an example of how to raise the center of gravity of a composite field hockey stick head by taking advantage of the hollow area inside the head. By strategically placing contours in the molds, the present invention shifts where the composite fills the mold. Thus, by not allowing the bottom portion of the head to fill with composite, the mass of the head is disposed higher on the head. To further enhance the reallocation of mass in the head, extra material, such as more resin, can also be added to the head before or after molding.

Figure 3:
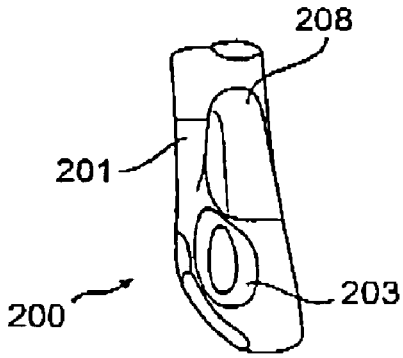
FIG. 3 is a schematic diagram of a side view of the field hockey stick shown in FIG. 2.

As shown in the example of FIG. 2, one embodiment of the present invention provides a field hockey stick 200 having a head 206 with one or more depressions 203 in its surface. In this example, head 200 has three depressions 203, which are generally oval in shape. The outside and inside ovals shown for each depression 203 indicate generally where each depression begins to descend (outside line) and then levels out somewhat (inside line) to form the base of the depression. FIG. 3 illustrates a side view of field hockey stick 200, showing the depression 203 nearest the toe 208. The depressions could, of course, be formed in many different numbers and shapes, for example, having a single rectangular depression with planar sloping walls, instead of rounded walls.

The depressions 203 in head 206 minimize the mass of the lower portion of head 200, and therefore raise the center of gravity of head 206 to above the traditional center of gravity that is in line with the center of gravity of a field hockey ball. Line 214, which is drawn at roughly the center of gravity of a field hockey ball (e.g., 1.40 to 1.47 inches), represents the line above which the center of gravity of head 206 is disposed, according to an embodiment of the present invention. For example, with depressions 203, the center of gravity of head 206 could be disposed at about 1.5 inches from the extreme end 209 of head 206.

The placement of depressions 203 raises the center of gravity of head 206, such that the center of gravity of head 206 is higher in relation to a ball struck by head 206, in comparison to traditional field hockey sticks. This higher center of gravity helps minimize the loft imparted on the ball. In one embodiment, depressions 203 are disposed within about 1.47 inches from end 209.

According to a particular implementation of the present invention, the center of gravity of head 206 is above a line drawn halfway between the highest point 210 of toe 208 and the extreme end 209 of head 206 opposite to point 210, when the distance between end 209 and point 210 is approximately 3.94 inches (which is the maximum distance allowed by widely accepted rules of field hockey). Such a line would be about 1.97 inches from end 209.

Figure 4:
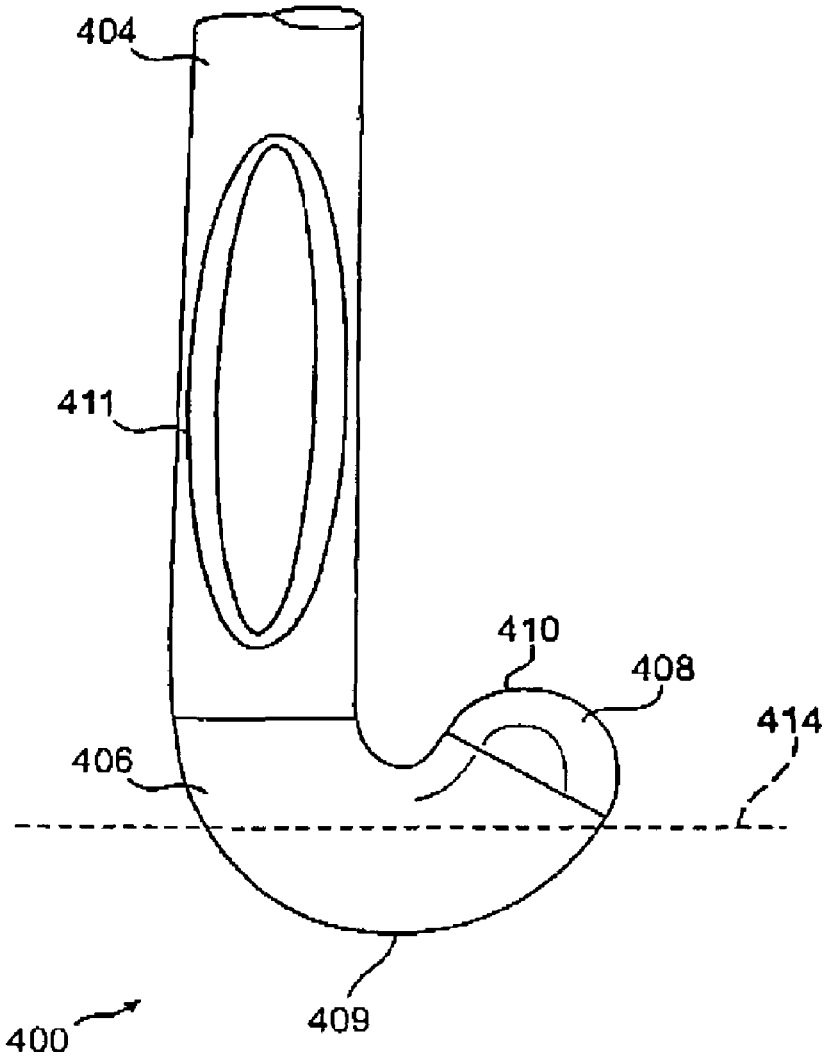
FIG. 4 is a schematic diagram of an exemplary field hockey stick having a depression in its throat, according to an embodiment of the present invention.

FIG. 4 illustrates another embodiment of the present invention in which the mass of the throat of a field hockey stick is reduced and shifted toward the upper portion of the head. As shown in this example, a field hockey stick 400 includes a depression 411 in the surface of its throat 404. Depression 411 can be disposed in throat 404 closer to head 406 than to a handle (not shown) attached to throat 404. Depression 411 can be disposed either in the flat playing side of throat 404 or, as shown in FIG. 4, in the round non-playing side of throat 404.

Figure 5:
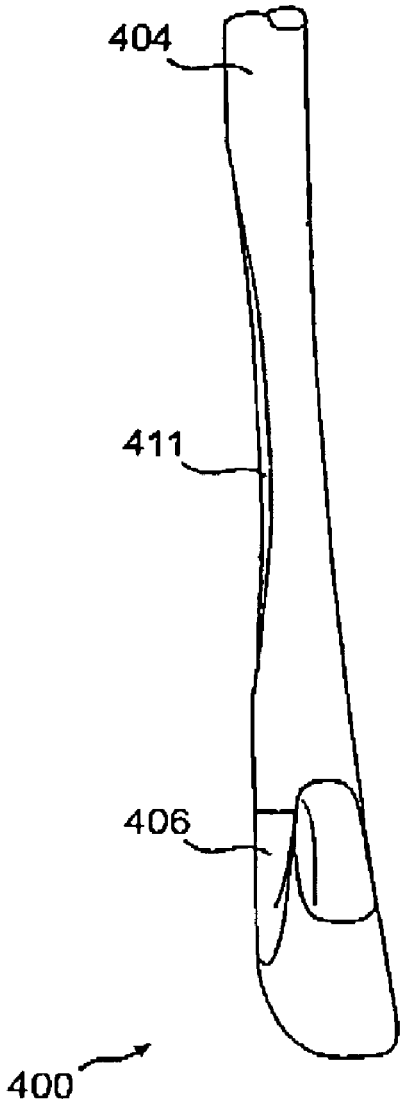
FIG. 5 is a schematic diagram of a side view of the field hockey stick shown in FIG. 4.

Depression 411 could be oval-shaped as shown in the example of FIG. 4. The outside and inside oval-shaped lines shown for depression 411 indicate generally where depression 411 begins to descend (outside line) and then levels out somewhat (inside line) to form the base of the depression 411. FIG. 5 illustrates a side view of field hockey stick 400, further showing the exemplary shape of depression 411. Depression 411 could, of course, be formed in many different numbers and shapes, for example, having multiple tear-shaped depressions.

Disposing depression 411 in throat 404 removes mass from throat 404 in the area just above the head 406, and redistributes this removed mass to the upper portion of the head 406. Line 414, which is drawn at roughly the center of gravity of a field hockey ball (e.g., 1.40 to 1.47 inches), represents the line above which the center of gravity of head 406 is disposed, according to an embodiment of the present invention. For example, with depression 411, the center of gravity of head 406 could be disposed at about 1.5 inches from the extreme end 409 of head 406. Adding the mass to the top portion of head 406 raises the center of gravity of head 406. Consequently, head 406 can strike a ball with a higher center of gravity and minimize loft on the ball.

According to a particular implementation of the present invention, the center of gravity of head 406 is above a line drawn halfway between the highest point 410 of toe 408 and the extreme end 409 of head 406 opposite to point 410, when the distance between end 409 and point 410 is approximately 3.94 inches (which is the maximum distance allowed by widely accepted rules of field hockey). Such a line would be about 1.97 inches from end 409.

Figure 6:
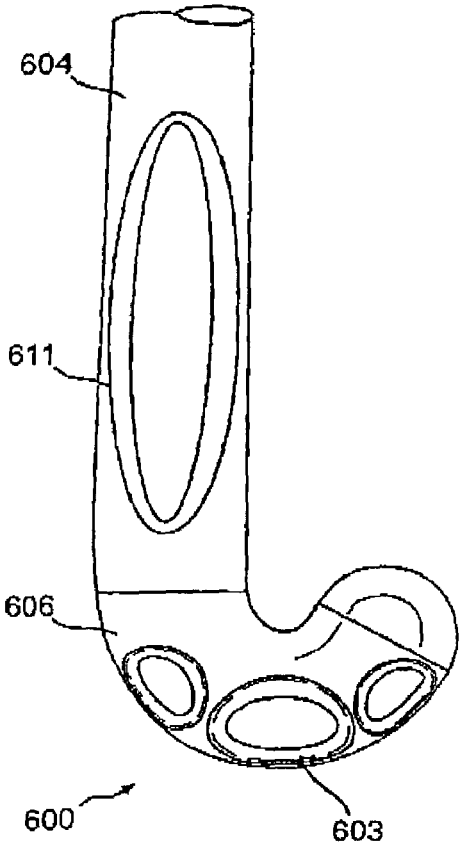
FIG. 6 is a schematic diagram of an exemplary field hockey stick having depressions in its head and a depression in its throat, according to an embodiment of the present invention.
Figure 7:
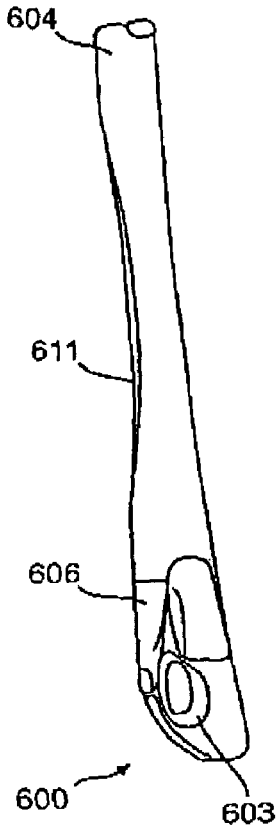
FIG. 7 is a schematic diagram of a side view of the field hockey stick shown in FIG. 6.

FIGS. 6 and 7 illustrate a further embodiment of the present invention in which a field hockey stick 600 has both a depression 611 in its throat 604 and also one or more depressions 603 in its head 606. As discussed above in reference to FIGS. 2–5, depression 611 and depressions 603 redistribute mass of the field hockey stick 600 to the upper portion of its head 606. Having mass redistributed by both depression 611 and depressions 603 accentuates the center of gravity situated in the upper portion of head 606.

Figure 8:
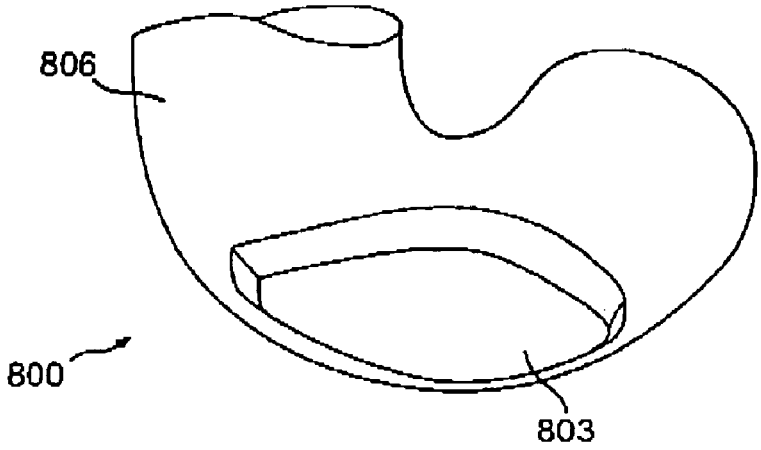
FIG. 8 is a schematic diagram of an exemplary field hockey stick having a single depression in its head, according to an embodiment of the present invention.
Figure 9:
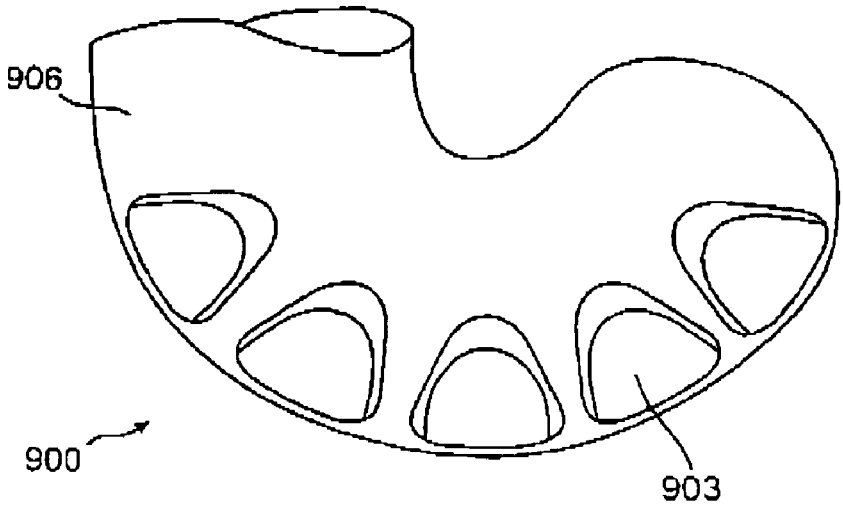
FIG. 9 is a schematic diagram of an exemplary field hockey stick having five roughly triangular depressions in its head, according to an embodiment of the present invention.

FIGS. 8–9 illustrate alternative embodiments of the present invention having different numbers and shapes of depressions on the head of a field hockey stick. For example, FIG. 8 illustrates a field hockey stick 800 having a head 806 with a single irregularly shaped depression 803 in its extreme end (opposite to the handle, not shown). As another example, FIG. 9 illustrates a field hockey stick 900 having a head 906 with five roughly triangular depressions 903.

In a further alternative embodiment, instead of or in addition to removing and redistributing mass of a field hockey stick, mass could be added to the stick. For example, a metal (e.g., lead), thermoplastic elastomer (TPE), or other material could be attached to the upper portion of the bead of the stick. For example, a plug made of a second material could be embedded (e.g., by laying up the plug) in the upper portion of the head. This additional material would raise the center of gravity of the head.

Figure 10:
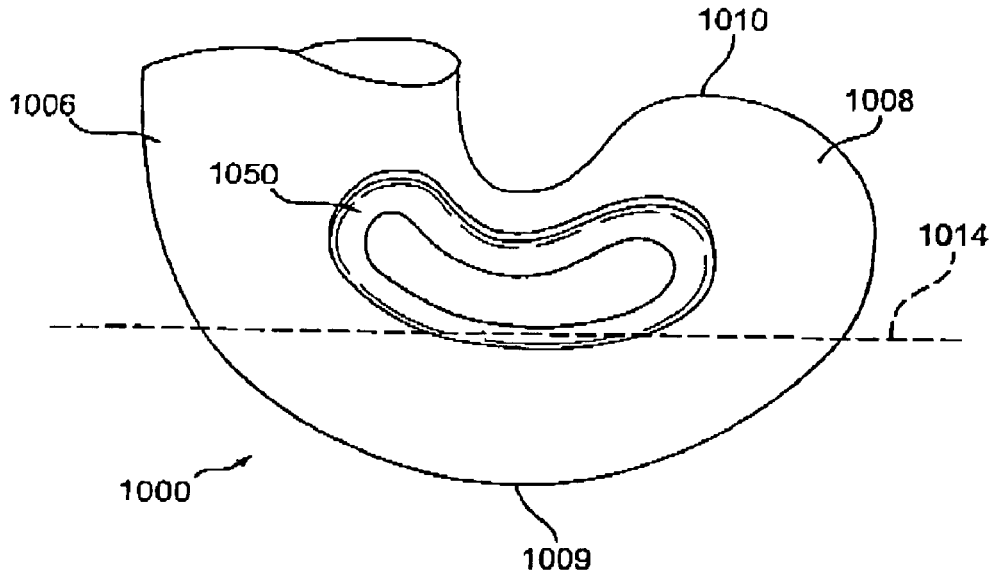
FIG. 10 is a schematic diagram of an exemplary field hockey stick having a mass added to the upper portion of its head, according to an embodiment of the present invention.

FIG. 10 illustrates an example of this embodiment, in which a field hockey stick 1000 has a head 1006 with a mass 1050 added to the upper portion of the head. Line 1014, which is drawn at roughly the center of gravity of a field hockey ball (e.g., 1.40 to 1.47 inches), represents the line above which the center of gravity of head 1006 is disposed, according to an embodiment of the present invention. For example, with mass 1050 added, the center of gravity of head 1006 could be disposed at about 1.5 inches from the extreme end 1009 of head 1006.

According to a particular implementation of the present invention, the center of gravity of head 1006 is above a line drawn halfway between the highest point 1010 of toe 1008 and the extreme end 1009 of head 1006 opposite to point 1010, when the distance between end 1009 and point 1010 is approximately 3.94 inches (which is the maximum distance allowed by widely accepted rules of field hockey). Such a line would be about 1.97 inches from end 1009.

Figure 11:
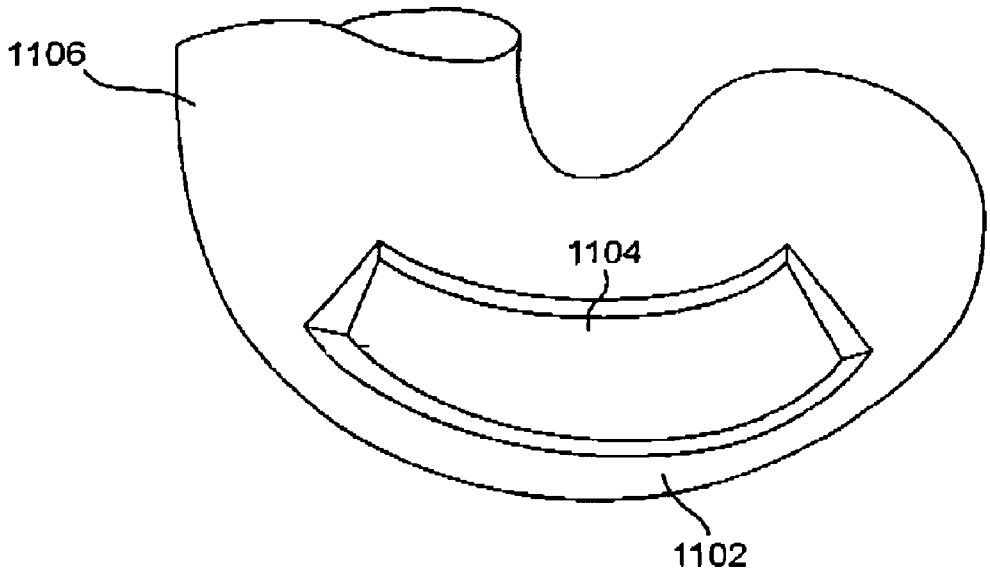
FIG. 11 is a schematic diagram of an exemplary field hockey stick head having a distal member and a depression, according to an embodiment of the present invention.

Another alternative embodiment of the present invention provides a field hockey stick with perimeter weighting, while still raising the center of gravity of the head. This perimeter weighting can improve the feel and control of the stick. As an example, FIG. 11 illustrates a field hockey stick head 1106 having a distal member 1102 and a depression 1104. As described above, depression 1104 enables the redistribution of mass to the upper portion of head 1106 to raise the center of gravity. At the same time, distal member 1102 provides a mass at the end of head 1106 that affords a perimeter weighting for the field hockey stick. Although FIG. 11 shows distal member 1102 in one particular form, many different forms of perimeter weight could, of course, be used, such as flanges, ribs, rims, or plugs. Plugs could be made, for example, of material heavier than the remaining material of the head.

An embodiment of the present invention uses composite materials to construct a field hockey stick having a top weighted head. The composites enable a gradual redistribution of the mass of the field hockey stick, while still providing the requisite degree of strength in the areas from which mass is moved. For example, with the embodiment providing a depression in surface of the round throat back, the mass in the throat can be moved downward to the head with gradual, undulating shapes, leaving a relatively thin area where the mass is removed that is still structurally strong enough to withstand the rigors of the game. The gradual reshaping and redistributing of material also enable the provision of cross sectional dimensions that comply with the traditional two-inch ring test.

Although discussed primarily in the context of composite field hockey sticks, one of ordinary skill in the art would appreciate that the present invention could apply equally well to field hockey sticks made of other materials, such as wood. In such cases, the throat and head depression(s) would be formed as appropriate for the material. For example, depressions could be carved out of a traditional wood field hockey stick.

A further embodiment of the present invention achieves a higher center of gravity by varying the material composition of the head. For example, the lower portion of a head could be made of a first material, and the upper portion of the head could made of a second material that is heavier than the first material. In this manner, the center of mass or gravity could be raised on the head without necessarily using depressions (as in FIG. 2) or adding a mass (as in FIG. 10). In the case of a composite stick, for example, lighter fibers could placed in the lower portion of the head, with heavier fibers located in the upper portion of the head. Heavier materials could also be laid up within the fibers to provide areas of greater mass in the upper portion of the head. Similarly, plugs made of heavier or lighter materials could be strategically positioned in the head to provide a raised center of gravity.

Thus, the top weighted field hockey sticks of the present invention provide a player with improved comfort, feel, and playability. In particular, the present invention raises the center of gravity of a field hockey stick head to minimize loft and impart an improved feel when striking a ball with the stick.

The foregoing disclosure of embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A field hockey stick comprising:

a throat; and a head adjoining the throat, the head being hollow and having an upper portion adjacent to the throat and a lower portion, and at least the lower portion of the head defining at least one depression and a distal mass, the distal mass providing perimeter weighting and being located below the at least one depression and below a center of gravity of a field hockey ball, the head having a center of gravity higher than the center of gravity of a field hockey ball.

2. The field hockey stick of claim 1, the at least one depression having a generally oval shape.

3. The field hockey stick of claim 1, the head having a first end attached to the throat and a second end opposite to the first end, and the at least one depression disposed within about 1.47 inches of the second end of the head.

4. The field hockey stick of claim 1, the head having a first end attached to the throat and a second end opposite to the first end, and the head having a center of gravity disposed greater than about 1.5 inches from the second end of the head.

5. The field hockey stick of claim 4, the second end of the head having the distal mass that provides perimeter weighting.

6. The field hockey stick of claim 1, the head having a toe and an end opposite to the toe, the distance between the toe and the end being about 3.94 inches, and the head having a center of gravity disposed greater than about 1.97 inches from the end of the head.

7. The field hockey stick of claim 1, the field hockey stick comprising a composite field hockey stick.

8. The field hockey stick of claim 1, the throat defining a throat depression in its surface.

9. The field hockey stick of claim 8, further comprising a handle adjoining the throat on a side of the throat opposite to the head, the throat depression being disposed in the throat closer to the head than the handle.

10. The field hockey stick of claim 8, the head having a first end attached to the throat and a second end opposite to the first end, and the head having a center of gravity disposed greater than about 1.5 inches from the second end of the head.

11. The field hockey stick of claim 8, the head having a toe and an end opposite to the toe, the distance between the toe and the end being about 3.94 inches, and the head having a center of gravity disposed greater than about 1.97 inches from the end of the head.

12. The field hockey stick of claim 8, the throat having a flat playing side and a non-flat non-playing side, and the throat depression being disposed in the non-playing side.

13. The field hockey stick of claim 1, the head having a flat playing side and a non-flat non-playing side, and the at least one depression being disposed in the non-playing side.

14. A field hockey stick comprising:

a handle;

a throat adjacent to the handle, the throat defining at least one depression; and a head adjacent to the throat on a side of the throat opposite to the handle, the head being hollow and having a first end attached to the throat and a second end opposite to the first end, and the head having a center of gravity disposed greater than about 1.5 inches from the second end of the head, wherein the second end has perimeter weighting lower than about 1.5 inches from the second end of the head.

15. The field hockey stick of claim 14, the at least one depression disposed closer to the head than the handle.

16. The field hockey stick of claim 14, the throat having a flat playing side and a round non-playing side, and the at least one depression being disposed in the round non-playing side.

17. The field hockey stick of claim 14, the at least one depression having an oval shape.

18. The field hockey stick of claim 14, the head having a toe and an end opposite to the toe, the distance between the toe and the end being about 3.94 inches, and the head having a center of gravity disposed greater than about 1.97 inches from the end of the head.

19. The field hockey stick of claim 14, the head having an upper portion attached to the throat and a lower portion opposite to the throat, and at least the lower portion defining at least one head depression.

20. The field hockey stick of claim 19, the head having a first end attached to the throat and a second end opposite to the first end, and the head having a center of gravity disposed greater than about 1.5 inches from the second end of the head.

21. The field hockey stick of claim 14, the field hockey stick comprising a composite field hockey stick.

22. A field hockey stick comprising:

a handle;

a throat adjacent to the handle, the throat having a flat playing side and a non-flat non-playing side, and the non-playing side of the throat defining at least one throat depression; and a head adjacent to the throat on a side of the throat opposite to the handle, the head being hollow and being attached at a first end and having a flat playing side and a non-flat non-playing side, and the non-playing side of the head defining at least one head depression and a distal mass, the distal mass providing perimeter weighting and being located at a second end of the head opposite to the first end and below a center of gravity of a field hockey ball, and the head having a center of gravity higher than the center of gravity of a field hockey ball.

23. The field hockey stick of claim 22, the at least one head depression disposed closer to an end of the head opposite to the throat than to the throat.

* * * * *